United States Patent [19]

Lloyd et al.

[11] Patent Number: 4,804,390

[45] Date of Patent: Feb. 14, 1989

[54] PROCESS FOR REMOVING MINERAL IMPURITIES FROM COALS AND OIL SHALES

[76] Inventors: Robert Lloyd, 7 Karalee Road, Galston, New South Wales; Maxwell J. Turner, 138A Kangaroo Point Road, Sylvania, New South Wales, both of Australia

[21] Appl. No.: 635,506

[22] Filed: Jul. 30, 1984

[30] Foreign Application Priority Data

Jul. 29, 1983 [AU] Australia ..... PH0574

[51] Int. Cl.[4] ..... C10L 5/00

[52] U.S. Cl. ..... 44/621; 44/627; 208/390; 423/461; 423/488; 423/489; 423/625; 423/626; 201/17

[58] Field of Search ..... 208/11 R, 390; 44/1 R, 44/15 R, 627, 621; 423/461, 488, 567 R, 489, 625, 626; 201/17

[56] References Cited

U.S. PATENT DOCUMENTS

| | | | |
|---|---|---|---|
| 1,803,943 | 5/1931 | Miller | 502/426 |
| 2,149,671 | 3/1939 | Heinrich | 423/461 |
| 2,624,698 | 1/1953 | Hickey | 423/461 |
| 3,501,272 | 3/1970 | Benak | 423/461 |
| 3,926,575 | 12/1975 | Meyers | 44/15 R |
| 3,998,604 | 12/1976 | Hinkley | 44/1 R |
| 4,083,940 | 4/1978 | Das | 423/461 |
| 4,134,737 | 1/1979 | Yang | 44/15 R |
| 4,415,478 | 11/1983 | Suggitt et al. | 423/461 |
| 4,424,062 | 1/1984 | Kamino et al. | 44/1 R |

FOREIGN PATENT DOCUMENTS

| | | | |
|---|---|---|---|
| 0016624 | 10/1984 | European Pat. Off. | 44/15 R |

*Primary Examiner*—Anthony McFarlane
*Attorney, Agent, or Firm*—Wigman & Cohen

[57] ABSTRACT

A process for removing mineral impurities such as metal oxides from coal and shale oil structures is disclosed. The process is carried out by subjecting crushed coal or shale to a hydrocarbon fluoride leaching solution, separating the HF leach liquor from the coal or shale, washing the coal or shale with water, leaching the washed coal or shale with hydrogen chloride solution, separating the HCl leach liquor from the coal or shale, washing the coal or shale with water, and removing residual impurities from the treated coal or shale by heating under a vacuum. The process allows for the recovery of carbons and hydrocarbons of high purity from coal or shale which do not require expensive emission control equipment when combusted.

3 Claims, 1 Drawing Sheet

PROCESS FOR REMOVING MINERAL IMPURITIES FROM COALS AND OIL SHALES

BACKGROUND OF THE INVENTION

The present invention relates to a process for removing mineral impurities, such as metal oxides, from coals and shale oil structures. The invention allows for the recovery of carbons and hydrocarbons of high purity from coal and shale oil. The mineral impurities removed from the coals and shales can also be recovered as useful by-products.

During World War II, the German chemical industry was able to prepare low ash carbon from coal in a process based on the reactions of non-oxidizing acids such as hydrofluoric and hydrochloric acids. However, these processes were not economically viable due to the high costs of obtaining those acids, and there was the further disadvantage of the contamination of the carbon product by the residue of those acids and their chemical derivatives, arising from the processes then being used. These prior art processes are also not viable at the present time as a result of the necessity of protecting the environment from contamination by waste products, particularly those containing fluoride salts. Present day pollution control laws in many countries prohibit the use of the processes as were used by the Germans during the 1930's and 1940's.

SUMMARY AND OBJECTS OF THE INVENTION

In view of the foregoing limitations and shortcomings of the prior art processes, as well as other disadvantages not specifically mentioned above, it should be apparent that there still exists a need in the art for a process, through which mineral impurities such as metal oxides may be effectively and economically removed from coal or oil shale using hydrogen chloride or hydrogen fluoride without adversely affecting the environment to produce a clean burning hydrocarbon product which will not require sophisticated and expensive machinery to treat the waste gases.

It is therefore a primary objective of this invention to fulfill that need by providing a process which allows for the complete recovery of the chlorine and fluorine used in the process for purification of coals, shales and other structures containing hydrocarbons.

It is another object of this invention to provide purified coals and other hydrocarbons prepared by the process of the present invention which lack contaminants such as vanadium, cadmium, mercury, phosphorus, selenium, and arsenic and of particular importance, radioactive elements such as uranium, thorium, and strontium which cause significant health problems when released from the burning of hydrocarbons and coal, as carried out throughout the world at the present time.

Yet another object of this invention is to purify coal or shale to a low enough heavy metal impurity level to meet the most stringent environmental control regulations without the need for expensive emission control equipment in power stations and the like.

Briefly described, the aforementioned objects are accomplished according to this invention by providing a process wherein impurities present with hydrocarbons in coals and oils are converted to soluble mineral fluorides or chlorides which are then leached out of the hydrocarbon structure.

After removal, the mineral fluorides and chlorides can be concentrated and recovered and those salts of value can form valuable raw materials for a variety of additional purposes.

The purified hydrocarbons resulting from the present process can be used for the manufacture of carbon and graphite electrodes and the like. Countries such as Australia and New Zealand must at the present time import carbon for such uses from overseas, and it is of great value for such countries to be able to manufacture feed stocks for the manufacture of graphite and carbon electrodes.

The invention provides in its broadest form a process for removing mineral impurities from coal or oil shale, the process comprising the steps of:

(a) crushing said coal or shale to a particle size between 30 and 100 mesh, (b) leaching the crushed coal or shale with HF solution, (c) separating the leach liquor containing dissolved mineral salts and fluorosilicic acid from the coal or shale, and washing the coal or shale with water, (d) leaching the washed coal or shale with HCl solution, (e) separating the leach liquor containing dissolved mineral salts from the coal or shale and washing the coal or shale with water, (f) removing residual impurities including HF, HCl and $SiF_4$ impurities by;

(i) heating the coal or shale at a temperature between about 20° to 100° C. under a vacuum and (ii) further heating the coal or shale at atmospheric pressure in a dry inert atmosphere;

and removing any gaseous impurities given off from the coal or shale.

The present process is applicable to any hydrocarbon containing structure, but coal and oil shale are the preferred such structures. In the remaining discussion of the invention specific reference is made to coal, but it should be understood that other hydrocarbon containing stuctures can be treated in a like manner to coal, and these are to be understood as being within the scope of the present invention.

It is preferred that before crushing the coal to a particle size between 30 and 100 mesh, the coal is dried to less than 0.5% by weight of moisture.

It is also preferred that the HF leach is a multi-stage countercurrent leaching process. It is most preferred that the process is a three stage countercurrent process. In the first stage, the coal, in a suitable granular form, meets with the HF solution which has previously contacted the coal in two other stages, when the HF is at its lower concentration. In the third stage the coal, which has already been partially leached in two previous stages, meets with the fresh HF solution, which is at its highest concentration.

In a similar manner it is preferred that the HCl leach is a multi-stage countercurrent leaching process, and it is most preferred that it is a two stage leaching process.

The spent liquors from the two leaching processes are preferably treated to recover the HF, HCl and the minerals removed from the coal. These minerals can be separated, purified and concentrated as by-products of the process.

Another advantage of the process is that coal particles which are not of a suitable size for the leaching process of the invention can be used as the necessary energy source for heating, producing steam, and running the process. It is also of advantage that the purified coal resulting from the process is in a fine granulated form, which is highly suitable for further processing.

It is preferred that the acidity of the acid after the leaching process is of the minimum concentration necessary to prevent the dissolved mineral salts from precipitating. The acidity of the hydrogen fluoride or hydrogen chloride introduced into each of the countercurrent leaching systems is adjusted in accordance with the proportion of impurities in the coal, so that the final solution is at this optimum concentration.

The feature of the hydrogen chloride leach occurring after the hydrogen fluoride leach is important to the invention, and has the highly desirable advantage that the hydrogen chloride solution will dissolve residual fluoride salts in the coal; salts which are not generally soluble in hydrogen fluoride solution, but which are soluble in hydrogen chloride solution. In particular, the hydrogen chloride leach will remove calcium and magnesium fluoride salts in a highly efficient manner. The hydrocarbon product resulting from this invention therefore has an extremely low calcium and magnesium level, which allows for the hydrocarbon product to be used in a variety of manufactures which in prior art processes, required expensive and complex further treatment.

Very little silica remains in the end product. In prior art processes, even small quantities of silica were of disadvantage, due to the extremely abrasive qualities of the silica. The present process has the advantage of removing very high proportions of the silica present because the vacuum drying step allows for the evaporation of silicon fluoride, $SiF_4$, and its subsequent collection.

The invention creates a product that is extremely low in moisture and ash and has an activated surface area and it can be easily reduced to small micron size. When such product is burnt a stoichiometric hydrogen carbon, oxygen ratio means that for the formation a complex metals/carbon/oxygen molecules there is insufficient free oxygen or carbon to allow such chemical combinations.

The invention allows the process to be controlled at low pressures and temperatures thereby ensuring that the fixed carbon and hydrogen carbon structues of the coal or shale are inert to the chemical reactions taking place between the reagent and the metal oxides. If such processes were carried out at higher temperatures or pressures, then the hydrocarbons can be volatilized and would react chemically with the other elements involved in the reaction causing the re-forming of poisonous hydrocarbon by-products and reducing the energy value of the process product.

The invention takes advantage of the fact that nature has removed free oils and tars from the surface of the coal or shale structures which means that unless the coal or shale is preheated to the leaching operation, there is no surface oil barrier between the chemical reagent and the ash elements.

The invention provides for the manipulation of the rate and extent of reaction between the hydrofluoric acid and the various metal oxides. By controlling the rate of reaction between the acid and the metal oxides it becomes possible to retard the reaction of a specific element, titanium, while at the same time maximizing the reaction between the gas and other elements to varying degrees.

The invention takes into account that any fluorine or chlorine chemically reacted to replace the oxygen in the oxides must be removed otherwise under the heat of combustion during burning of the product, such metal fluorides that remain in the product will be hydrolyzed by the water content present and will convert to hydrofluoric acid in the gas stream. By selective conversion of the oxide to fluorides a control is obtainable over the level of various elements remaining in the very low residual ash in the coal.

An important feature of the invention is that it permits the product produced by the process to contain within the very small amounts of residual ash left, precise metal oxides not fluorides that when burnt produce agglomerate combinations of extremely high fusion ash temperature which when subject to the temperature of combustion do not become moist, soft, or liquid and have now reactivity to the metal or ceramic combinations in the engine, boiler, or heat appliance in which the fuel is used.

The present process uses coal as an example, but other hydrocarbon containing structures can also be used in an equivalent manner.

BRIEF DESCRIPTION OF THE DRAWING

The disclosed FIGURE is a flow chart of a preferred embodiment for carrying out the invention.

DETAILED DESCRIPTION OF A PREFERRED EMBODIMENT

Figure 1:
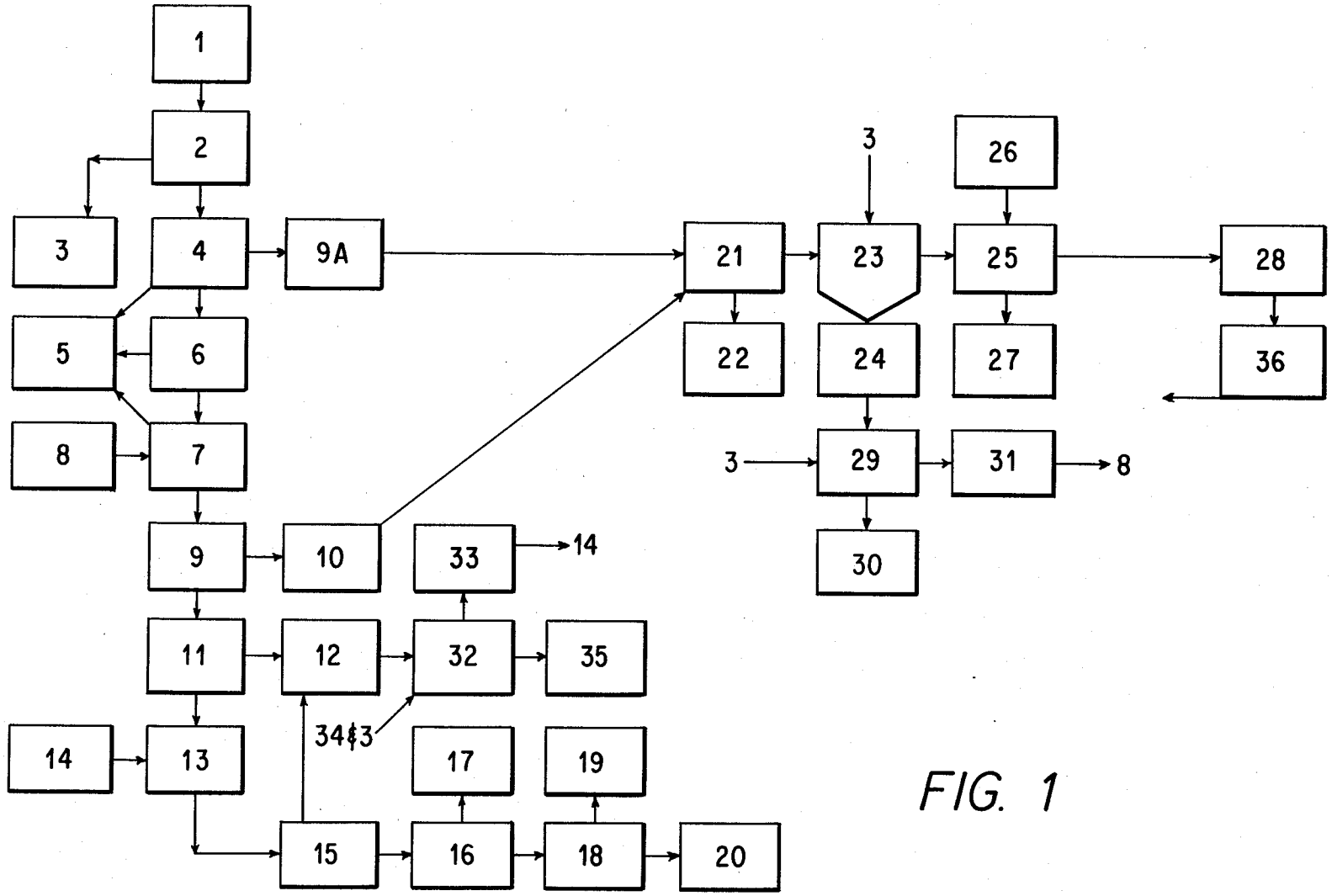

The steps of the preferred process of the invention are defined in relation to the numbered boxes in the flow chart.

1. Coal or oil shale can be used as feed stock for this process, but in the preferred embodiment now described, the grade of coal used is that generally mined in New South Wales. As the carbon and hydrogen structure of the coal is basically not affected by the process of the invention, the end product can be varied according to the particular type and grade of coal used as a feed stock.

2. The coal is dried to less than half percent by weight of moisture, and crushed to a particle size of between 30 and 100 mesh.

3. It is common for about 6 percent of the coal particle resulting from crushing, to be smaller than 100 mesh. This proportion of coal is removed (3) and used as a heat source for steam generation for drying and heating, and for generally running the plant.

4. Coal particles having a size between 30 and 100 mesh are fed to a primary reactor (4) for the first stage of the HF leach. The second stage of the leach is item (6) and the third stage is item (7) in the flow chart. In the first stage in the leach (4) the coal comes in contact for the first time with the hydrogen fluoride solution. The HF leaching solution has peviously passed through the other two stages in the HF leaching process. The coal in the first stage has its highest mineral content for the leaching process, and the hydrogen fluoride solution is at its lowest acidity when it enters this stage. The hydrogen fluoride solution containing the dissolved mineral fluorides has an acidity level sufficient to prevent the salts from precipitating. However, other than this requirement, the hydrogen fluoride concentration is preferably regulated to the minimum concentration required for the spent reagent. The spent reagent passes to holding tank 9A and then to further processing.

5. In each of the three stages in the countercurrent leaching process, there is incorporated in the floor of each leaching chamber a low current flow area in the stirring cycle of each vessel. The difference in specific gravity between the coal and any iron pyrite impurity which has been liberated from the coal by the leaching action, allows the pyrite to be collected on the floor of the chamber, and thus allows for its subsequent removal.

6. In the second stage of the three stage countercurrent leaching process the reagent liquor from the third stage meets the coal from the first stage. The hydrogen fluoride is at a higher concentration than in the first stage and as a result, different leaching reactions occur in the second stage. The hydrogen fluoride present reacts with silica to produce fluorosilicic acid, $H_2SiF_6$, in this stage as well as in other stages of the process. Fluorosilicic acid assists hydrogen fluoride in the required leaching action.

7. In the third stage of the countercurrent process the coal from the second stage meets fresh hydrogen fluoride leaching reagent.

8. The fresh hydrogen fluoride solution is introduced from a storage tank at an appropriate acidity level to ensure that the spent liquor leaving the first stage of the process is sufficiently acidic to prevent precipitation of mineral salts, but otherwse is at a minimum concentration. The hydrogen fluoride in the storage tank is supplied from the pyrohydrolizer (29) via HF storage tank (31).

9. & 10. The coal leaving the third stage of the countercurrent leaching process contains liquor in which a large quantity of metal fluorides is dissolved. The coal is vigorously washed with water (9) from makeup tank (36) and resulting liquid is sent to a water storage tank (10) in which there is sufficient acidity so that the metal fluorides remain substantially in solution.

11. The leach with hydrogen chloride solution is a two stage countercurrent process. In the first stage (11) certain metal fluorides, such as calcium and magnesium fluorides, which have low solubility in hydrogen fluoride solution and which are very soluble in hydrogen chloride solution are leached from the coal. The hydrogen chloride solution used in the first stage comes from the second stage of the process (13).

12. The spent hydrogen chloride liquor containing dissolved fluoride salts, and additional mineral salts from the leaching, is sent to storage tank (12).

13. In the second stage of the hydrogen chloride leach (13), the coal from the first stage is contacted with hydrogen chloride solution.

The hydrogen chloride makeup tank (14) is supplied from HCl storage tank (33) on recycle from the evaporator (32). Hydrogen chloride solution from storage tank (14) is used in the second hydrogen chloride leach stage (13) to maintain an appropriate level of acidity.

15. The coal leaving the hydrogen chloride leaching stage (13) contains residual liquor in which mineral salts are dissolved. In vessel (15) the coal is vigorously washed and the liquid residue is discharged to hydrogen chloride waste storage tank (12).

16. The coal from the previous washing stage contains moisture, and in this moisture is a small quantity of $SiF_4$, in the hydrated form as $H_2SiF_6$. It is necessary to remove both the silicon and the moisture from the coal. The present process prevents the silicon being precipitated as $SiO_2$, and remaining in the coal with subsequent contamination of the coal. The coal is therefore dried under a vacuum at a temperature from about 20° to 100° C. or preferably for 30° to 60° C. The preferred temperature is about 40° C. There is sufficient vacuum so that the silicon fluorides evaporate from the coal. The gaseous products from this stage are primarily $SiF_4$, HF and some HCl.

17. The gaseous products from the previous vacuum evaporation step are collected in tank (17) and in this tank a scrubber removes from the gaseous stream any gaseous elements present, such as $SiF_4$, HF and HCl.

18. The coal passes to a heating chamber where, at atmospheric pressures, in an inert atmosphere, the coal particles are heated to allow any remaining HF or HCl molecules to be liberated.

19. The liberated gases from the previous step are collected in a collection tank (19), and if desired HCl and HF are separated for recycling to the leaching sections.

20. The coal resulting from the process is stored under an inert gas blanket in the absence of moisture. Care must be taken to avoid oxidation and moisture pickup due to the hydroscopic nature of the purified coal.

The remaining sections of the flow chart describe processes for recovering the reagehts used in the process and the mineral by-products.

21. The spent liquor arising from the fluoride leaching process, containing various fluoride salts, is collected in mixing tank (21). A significant proportion of the salts present are $AlF_3$ and $H_2SiF_6$. Also present are a variety of mineral oxides which have been removed in the leaching stages. To this mixing tank (21) is added high alumina clay. The alumina in the clay reacts violently with the $H_2SiF_6$ to product $AlF_3$ and $SiO_2$.

22 & 23. The $SiO_2$ is filtered and stored in tank (22). The liquor from the mixing tank (21) is passed to crystallizer (23). The crystallizer is heated with steam from a boiler which powered by the rejected coal (3).

24. The $AlF_3$ is crystallized and is passed to storage tank (24) for storage.

25. The water from the crystallizer, which contains the residue metal fluorides not so far crystallized, passes to ion exchange column (25). The ion exchange column removes metal ions from the water stream and the resulting deionized water is stored in storage tank (28).

26. When the ion exchange column (25) becomes saturated, acid from tank (26) is used to regenerate the column, and flush metal ions from the exchange column.

27. The liquor from the ion exchange column containing metal ions, is collected in trace metal storage tank (27) for further processing, or disposal.

28. the water from the ion exchange column (25) is stored in storage tank (28) and tested for impurities. If the water is sufficiently pure, it is passed to a large storage tank (36).

29. The aluminum trifluoride from storage tank (24) is passed to a pyrohydrolizer (29) in which the aluminum trifluoride is treated with steam from the boiler (3) and is converted to A1203 and hydrogen fluoride.

30. The $Al_2O_3$ is stored in storage tank (30) for further treatment or removal.

31. The hydrogen fluoride is stored in tank (31) where it is used as makeup to the leach vessel storage tank (8).

33. The hydrogen chloride solution, after the leaching stage, passes from storage tank (12) to evaporator (32) where the water and solids are separated by heat supplied from boiler (3). The hydrogen chloride and water are collected in tank (33) where they are passed to makeup tank (14).

35. The metal residues from the evaporator (32) are passed to storage tank (35) for further processing or removal.

36. The water makeup storage tank (36) is filled with de-ionized water which is used for the water required in the various processes. Excess water is discharged as waste, after monitoring, to ensure that the purity of the water is within the necessary environmental restraints.

Although only a preferred embodiment of the invention is specifically illustrated and described above, it will be appreciated that many modifications and variations of the present invention are possible in light of the above teachings and within the purview of the appended claims without departing from the spirit and intended scope of the invention.

What is claimed is:

1. A process for removing mineral impurities from coal or oil shales, comprising the steps of:

crushing said coal or shale;

leaching the crushed coal or shales with HF solution;

separating the leaching solution of HF containing dissolved mineral salts and fluorosilicic acid from the coal or shales and washing the coal or shale with water;

leaching the washed coal or shale with HCl solution;

separating the leaching solution of HCl containing dissolved mineral salts insoluble in HF solution from the leached coal or shale and washing said leached coal or shale with water;

heating the coal or shale at a proper temperature sufficient to remove residual impurities including HF, HCl, and $SiF_4$;

adding alumina clay to the leaching HF solution containing dissolved mineral salts to cause the reaction of said alumina with $H_2SiF_6$ contained in said leaching HF solution to produce $AlF_3$ and $SiO_2$;

crystallizing and depositing the $AlF_3$; and heating the crystallized $AlF_3$ to produce $Al_2O_3$ and HF.

2. A process for removing mineral impurities from coal or oil shales, comprising the steps of:

crushing said coal or shale;

leaching the crushed coal or shales with HF solution;

separating the leaching solution of HF containing dissolved mineral salts and fluorisilicic acid from the coal or shales, and washing the coal or shale with water;

leaching the washed coal or shale with HCl solution;

separating the leaching solution of HCl containing dissolved mineral salts insoluble in HF solution from the coal or shale and washing the coal or shale with water;

heating the washed coal or shale at a proper temperature sufficient to remove residual impurities including HF, HCl, and $SiF_4$;

heating the leaching HCl solution containing $MgF_2$ and $CaF_2$; and collecting the separated HCl from said heating step.

3. In a hydrogen fluoride leaching process for removing mineral impurities from coal or oil shales and for recovering hydrogen fluoride from said leaching process, the improvement comprising the following steps:

adding alumina clay to a leaching HF solution containing dissolved mineral salts and fluorosilicic acid to cause the reaction of said alumina with $H_2SiF_6$ contained in the leaching solution of HF to produce $AlF_3$ and $SiO_2$;

crystallizing and depositing the $AlF_3$; and heating the crystallized $AlF_3$ to produce $Al_2O_3$ and HF.

* * * * *